US005567114A

United States Patent [19]

Wallace

[11] Patent Number: 5,567,114

[45] Date of Patent: Oct. 22, 1996

[54] FAN CLOSURE FLAP

[75] Inventor: Allen K. Wallace, Hindmarsh, Australia

[73] Assignee: F F Seeley Nominees Pty Ltd, St. Marys, Australia

[21] Appl. No.: 427,794

[22] Filed: Apr. 26, 1995

[30] Foreign Application Priority Data

Apr. 27, 1994 [AU] Australia ..... PM 5302

[51] Int. Cl.[6] ..... F04D 29/00

[52] U.S. Cl. ..... 415/146; 454/360

[58] Field of Search ..... 415/26, 49, 146; 454/259, 360

[56] References Cited

U.S. PATENT DOCUMENTS

| | | | |
|---|---|---|---|
| 1,613,897 | 1/1927 | Lichty et al. | 454/259 |
| 2,502,736 | 4/1950 | Marcoe | 454/259 |
| 3,479,947 | 11/1969 | Myers | 415/26 |
| 4,385,552 | 5/1983 | Nabben | 415/146 |

*Primary Examiner*—James Larson

*Attorney, Agent, or Firm*—Watts, Hoffmann, Fisher & Heinke Co., L.P.A.

[57] ABSTRACT

This invention relates to a closure for the outlet of a fan. A fan has an outlet opening 12 in a fan case volute 10 which is closed by a hinged flap 13, the weight of the flap being compensated by a counterweight arm 15. When the flap 13 closes opening 12, counterweight arm 15 is latched by latch 32 carried by spring 26 which must deform before the flap can open. Alternatively, the latch 32 is itself a resilient spring. The flap will only open when sufficient static pressure is applied by the fan, and the resilient latch 25, 32 will prevent "flutter" which might be otherwise caused by outside air currents.

6 Claims, 2 Drawing Sheets

FAN CLOSURE FLAP

This invention relates to closure means for closing the outlet opening of a fan casing which, for example, may be a volute (scroll) of a fan of the centrifugal type, or the outlet of an axial flow type fan. It is particularly useful for a fan assembly mounted outside of a building, to avoid inflow of cold outside air in the winter.

BACKGROUND OF THE INVENTION

It is common to use centrifugal fans secured to the external structures of buildings for delivering air through ducts to the interiors of the buildings. In a previous application of Applicant's, No. PM 2487 dated 18 Nov. 1993, there was a description of fan closure means which is arranged to be inserted in the eye of a fan case volute, for example at the end of a season, to inhibit down drafts of air from external winds into a building and to inhibit warm air escaping from the building through the duct. Such an arrangement functions very satisfactorily, but requires manual positioning which is sometimes most inconvenient.

Both counterweighted closure flaps and retaining latches for closure flaps are already known in the art, for example in Australian Patent Application Nos. 69233/81 (542813) and 25236/77. However, what is not otherwise known to the Applicant is a combination wherein a resilient latch is associated with a counterweighted flap, but is releasable only when sufficient static pressure is generated by the fan, to allow the flap to open. This is a very desirable feature, since opening can be completely automatic, but the flap is unlikely to "flutter" under windy conditions.

BRIEF SUMMARY OF THE INVENTION

In order to provide means which will function automatically and will open when a fan is in operation but will close when it is not, in an embodiment of this invention there is provided a flap which is hinged with respect to a fan case volute and which is movable between an open position wherein it causes minimal interference with free flow of air being delivered to a duct from a fan, to a closed position where it blocks the outlet opening of the fan, and a latch to retain the flap in its closed position until sufficient static pressure is built up by the fan to cause it to open, whereupon it moves to an open position where it has little or no effect on the free flow of air emitting from the outlet opening.

There are two problems which are encountered with such an arrangement, which it is the object of this invention to overcome. Firstly, when the fan is idle there must be return means, and these can clearly be constituted by a weight or a spring, and secondly, when the outlet of the fan volute is closed, the flap should be protected against "flutter" due to external or internal pressures or wind gusts.

More specifically, in this invention there is provided a flap, hinge means hinging the flap to the casing for movement between a normally closed position wherein said flap at least partly closes said outlet opening and an open position wherein there is a free flow of air from said opening, a counterweight arm associated with said flap and hinge means hinging said flap towards its normally closed position, and a latch releasably retaining said flap in its closed position, the latch comprising resilient means deflected upon latch release.

BRIEF DESCRIPTION OF THE DRAWINGS

Two embodiments are described hereunder in some detail with reference to and are illustrated in the accompanying drawings wherein.

DESCRIPTION OF THE PREFERRED EMBODIMENTS

Figure 1:
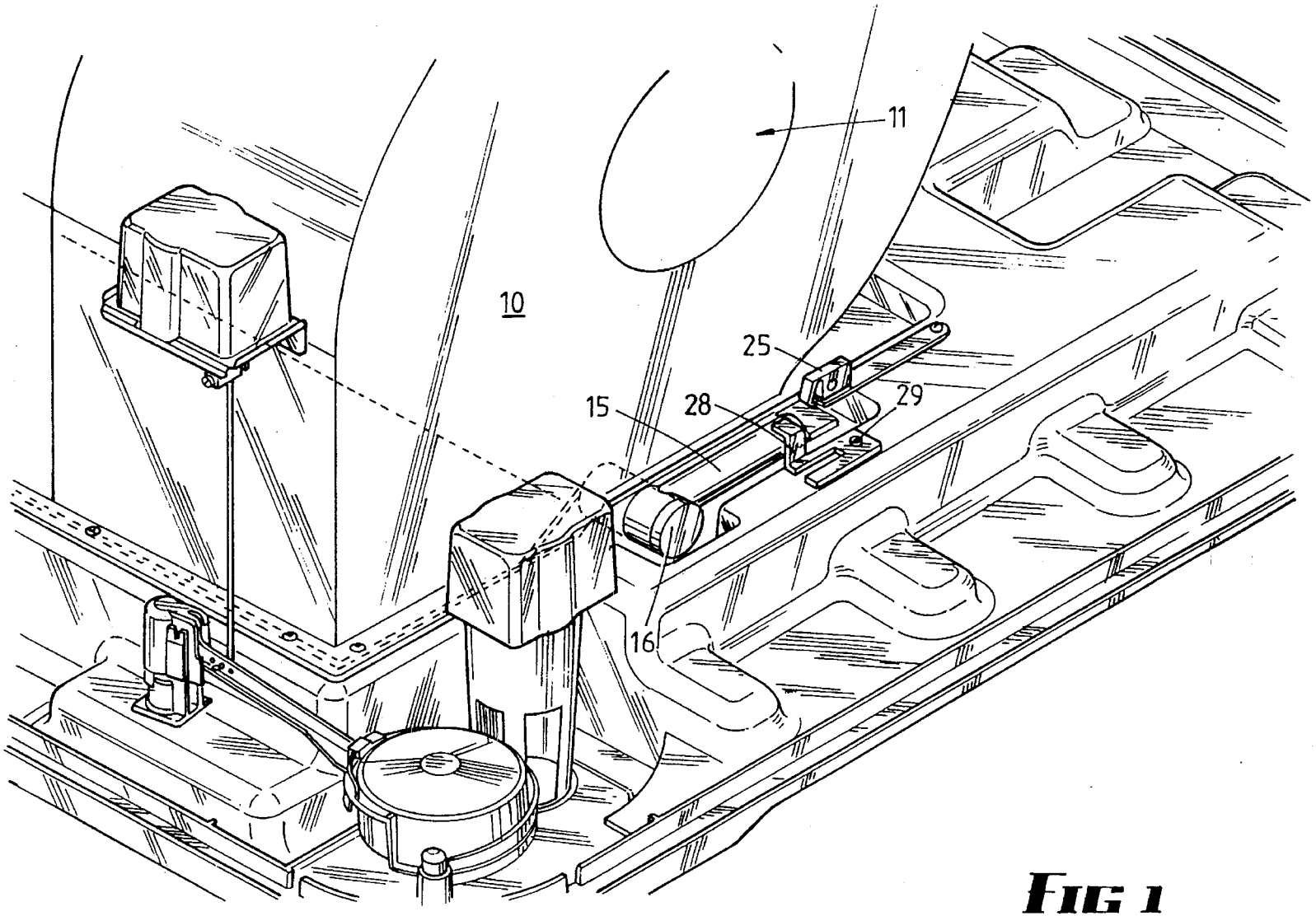
FIG. 1 is an isometric side elevation showing a fan case volute with a closure flap in its closed position and being retained there by a counterweight which is also associated with a retention latch.
Figure 2:
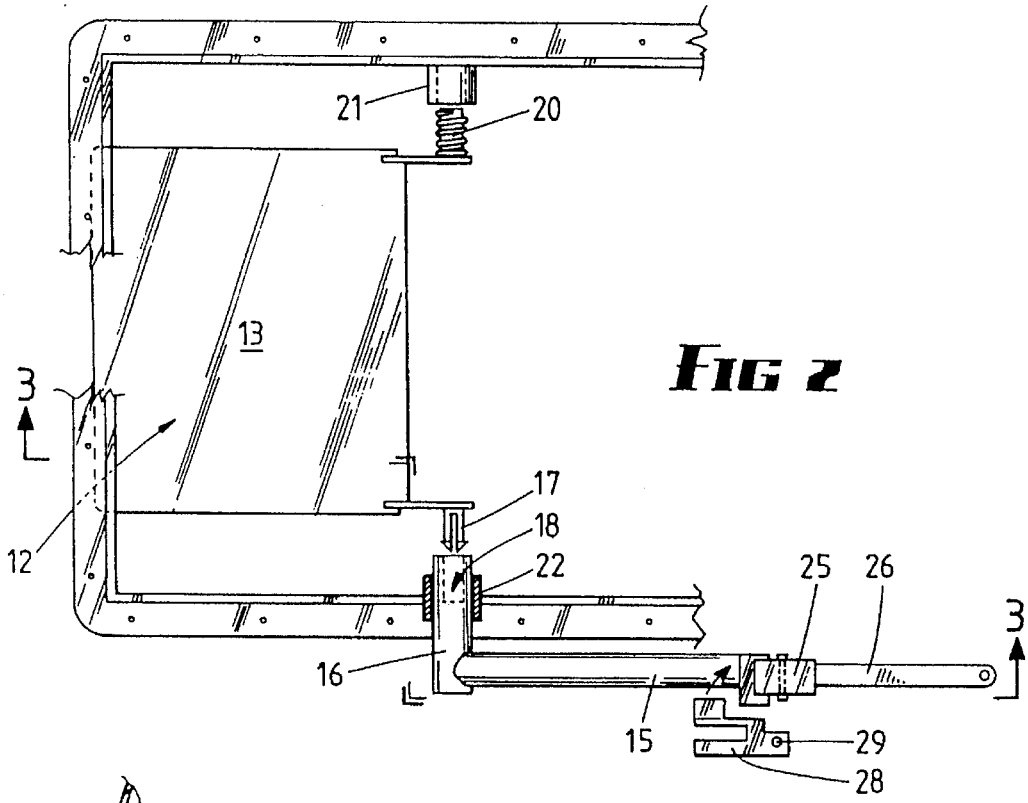
FIG. 2 is a diagrammatic plan showing the flap, the bearing arrangement for pivotal movement of the flap, the counterweight and the latch.
Figure 3:
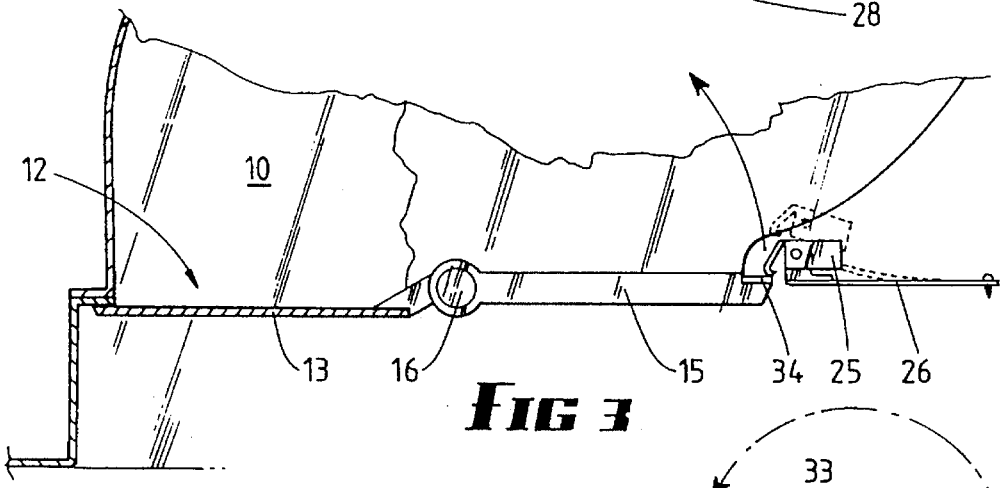
FIG. 3 shows the counterweight and latch in a partly sectioned side elevation, in a view taken on line 3—3 of FIG. 2.

Referring to the first embodiment of FIGS. 1, 2 and 3, a fan case volute 10 of a centrifugal fan is in accordance with known art having an inlet 11 and an outlet 12, the fan being operable in the normal way to draw air through the inlet 11 and discharge through the outlet 12. In the winter months when air conditioning is not required in certain climates, it is desirable that the outlet 12 should be closed against downdrafts, and to this end there is provided a flap 13 which can be opened by the static pressure of air when the fan is operating, but it is otherwise normally closed.

A counterweight arm 15 is carried on an extending end of pivot shaft 16 which carries flap 13, via an engaging spigot 17 which non-rotatably engages in aperture 18 on inner end of shaft 16.

A stub axle 20 on the side of flap 13 from spigot 17 is rotatable in bearing 21 carried on the casing volute 10, and is co-axial with shaft 16, which is also rotatable in bearing 22.

When flap 13 closes outlet 12, flap 13 and countershaft 15 are both generally horizontal, although this is not essential. The clockwise moment due to the counterweight is greater than the anticlockwise moment due to weight of the flap 13, so that when the fan is not operative, the flap 13 will close outlet 12 as shown in FIG. 3. In doing so it will pass pivoted latch 25 which is carried on one end of leaf spring 26, and latch 25 will need to deflect spring 26 (FIG. 3) to allow opening of flap 13. This will occur only upon the fan being energised, since it is only under those conditions that the standing pressure of air on flap 13 is sufficient to deflect spring 26. When flap 13 approaches vertical, a balanced condition is approached, and air flow past the flap 13 is sufficient to retain the flap open. The constraint against free flow of air is negligible.

The swivel lock 28 can swivel about pin 29 to overlie counterweight 15 (or latch 25, or both) to retain flap 13 closed during transport of the fan.

Figure 4:
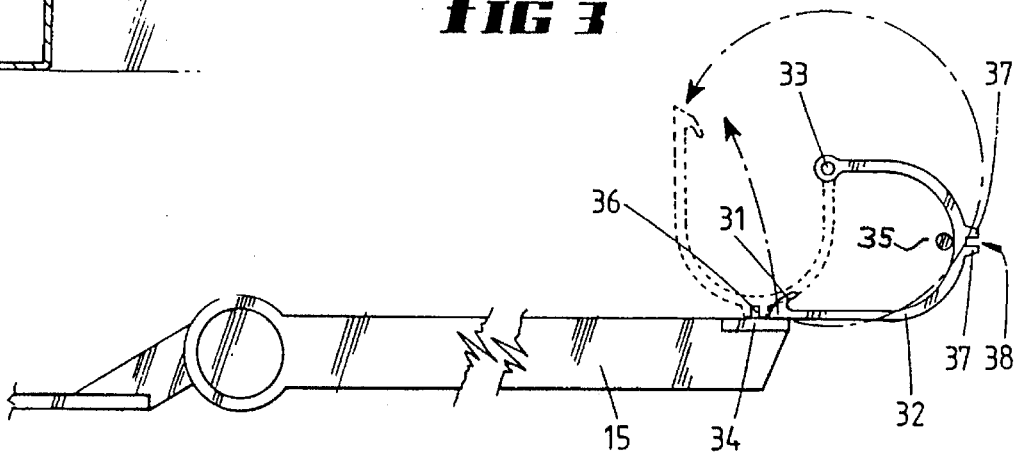
FIG. 4 shows an alternative arrangement which is a second embodiment.

FIG. 4 shows a second embodiment which is preferred to the first embodiment, not because it functions better, but because it is much simpler.

In FIG. 4, counterweight arm 15 when closing the flap encounters a ramp face 31 of a resilient hinged horse-shoe shaped latch 32. Latch 32 is thereby deflected in a counter clockwise direction from its solid line position of FIG. 4, hinging about hinge pin 33, until it is free to swing back over the upper face of abutment plate 34 of counterweight arm 15, under its own weight. Any small tendency for the latch 32 to lift is countered by deflection of the latch, which is inhibited against clockwise rotation by stop 35. However, a larger force applied to flap 13 by energising the fan, will be sufficient to cause deflection of the latch 32 so that its underface slopes with respect to the upwardly swinging end of counterweight arm 15, and this will deflect the resilient latch 32 and initiate counter-clockwise rotation of latch 32 from its solid line position of FIG. 4.

Counterweight arm 15 has an upstanding spigot 36, and the central part of the outer surface of latch 32 has two spaced lugs 37 which define a slot 38 between them, and this accommodates spigot 36 when in the transport mode. This transport mode is the position shown in dashed lines in FIG. 4. Although resilient, latch 32 can hold counterweight arm 15 against counter clockwise rotation under most conditions of transport, the transport mode is nonetheless provided to assure the flap 13 will be maintained in its closed position during shipment.

The invention will be seen to be exceedingly simple but is nevertheless effective in substantially reducing if not eliminating down draft and the device can be constructed so that probability of malfunction is very small.

We claim:

1. Closure means for closing an outlet opening of a casing of a fan assembly having a motor driven air flow impeller within the casing, comprising a flap, hinge means hinging the flap to the casing for movement between a normally closed position wherein said flap at least partly closes said outlet opening and an open position wherein there is a free flow of air from said opening, a counterweight arm associated with said flap and hinge means urging said flap towards its normally closed position, and a latch releasably retaining said flap in its closed position, wherein said latch includes resilient means deflected upon latch release.

2. Closure means according to claim 1 wherein said latch resilient means applies pressure against said counterweight arm in a closure direction when said flap moves away from its closed position upon opening of said flap.

3. Closure means for closing an outlet opening of a case of a fan assembly having a motor driven air flow impeller within the case, comprising a pivot shaft journalled for pivoted movement in said case, a flap carried by said shaft and movable between a position over said outlet opening to substantially close said opening, and an open position wherein there is free flow of air from said opening, a counterweight arm also carried on said shaft but externally of said case, a latch carried by said case and operatively associated with a swinging end of said counterweight arm to retain said counterweight arm from movement in an opening direction of said flap, and resilient means coupling said latch to said case and deformable upon static pressure being imparted to said flap in the opening direction by operation of said impeller to release latch engagement with said counterweight arm.

4. Closure means according to claim 3 further comprising an elongate leaf spring secured at one of its ends to said case, said latch comprising a latch member, and pivot means carried by the other end of said leaf spring supporting said latch member for pivotal movement with respect thereto.

5. Closure means for closing an outlet opening of a case of a fan assembly having a motor driven air flow impeller within the case, comprising a pivot shaft journalled for pivoted movement in said case, a flap carried by said shaft and movable between a position over said outlet opening to substantially close said opening, and an open position wherein there is free flow of air from said opening, a counterweight arm also carried on said shaft but externally of said case, a resilient latch carried by said case and operatively associated with a swinging end of said counterweight arm to retain said counterweight arm from movement in an opening direction of said flap, and deformable upon static pressure being imparted to said flap in the opening direction by operation of said impeller to release latch engagement with said counterweight arm.

6. Closure means according to claim 5 wherein said resilient latch comprises a horse-shoe shaped resilient member, and a hinge pin carried by said case hinging one end of said horse-shoe shaped member with respect thereto, the other end of said horse-shoe shaped member abutting a surface on said swinging end of said counterweight arm to effect said retention of the counterweight arm from movement in the opening direction until said static pressure is imparted to said flap.

* * * * *